United States Patent [19]

Baillod

[11] Patent Number: 4,491,225

[45] Date of Patent: Jan. 1, 1985

[54] SHOCK CUSHIONING PACKAGE

[75] Inventor: Frédéric Baillod, La-Chaux-de-Fonds, Switzerland

[73] Assignee: SRP, Inc., Greer, S.C.

[21] Appl. No.: 473,346

[22] Filed: Mar. 8, 1983

[51] Int. Cl.[3] ..... B65D 85/30; B65D 81/10

[52] U.S. Cl. ..... 206/583; 206/521; 206/594; 206/585; 206/507

[58] Field of Search ..... 206/583, 585, 521, 522, 206/594, 505, 507, 508, 484, 204, 205; 267/141, 153, 161

[56] References Cited

U.S. PATENT DOCUMENTS

| | | | |
|---|---|---|---|
| 1,205,362 | 11/1916 | Lang | 229/29 F |
| 2,501,570 | 3/1950 | Larsen | 206/583 |
| 2,681,142 | 6/1954 | Cohen | 206/522 |
| 2,837,208 | 6/1958 | Lingenfelter | 206/583 |
| 2,947,529 | 8/1960 | Schwartz et al. | 267/161 |
| 3,055,495 | 9/1962 | Naimer | 206/583 |
| 3,660,337 | 6/1972 | Struble | 152.4/428 |
| 3,752,301 | 8/1973 | Bluemel | 206/583 |
| 3,949,879 | 4/1976 | Peterson | 206/522 |
| 4,030,603 | 6/1977 | Angell | 206/583 |
| 4,055,672 | 10/1977 | Hirsch et al. | 206/484 |
| 4,238,845 | 12/1980 | Haggard et al. | 267/161 |

FOREIGN PATENT DOCUMENTS

| | | |
|---|---|---|
| 1461963 | 5/1969 | Fed. Rep. of Germany . |
| 2073269 | 10/1971 | France . |
| 630313 | 6/1982 | Switzerland . |

*Primary Examiner*—William T. Dixson, Jr.
*Assistant Examiner*—Brenda J. Ehrhardt
*Attorney, Agent, or Firm*—Thomas J. Morgan

[57] ABSTRACT

The invention comprises a package having a pair of concave mating portions and an elastic membrane secured in elastic tension to the periphery of the mouth of each mating portion, the tension being such as to permit the positioning of articles between the membranes. The package is adapted to function as a fluid damped device in which damping results from restricted gas flow and in which the membranes act as a damped compound spring to protect articles positioned therebetween from mechanical shock and vibration.

20 Claims, 4 Drawing Figures

SHOCK CUSHIONING PACKAGE

This invention provides an improved sealing, cushioning package which protects delicate, fragile or shock-sensitive articles during shipping and storage.

Industry is continually seeking better packages in which to ship delicate, fragile or shock-sensitive articles: watchcases, watch movements, electronic components, precision instruments, glassware, nitroglycerine, etc. In recent years packaging for many of such articles has evolved to the use of plastic foams shaped by cutting or molding to fit the article being shipped, and so-called blister packs made of two selectively sealed pliable plastic sheets having a plurality of air pockets or bubbles formed between them. Such packages or packing materials, however, are not without shortcomings for certain packaging uses.

Foam shapes must be individually formed to the article being packed, require large scale handling, and do not permit the article to be seen inside the package. Blister packaging, while free of certain of these shortcomings (it is somewhat transparent, for example) suffers from other deficiencies. Blister packaging is not feasible for small items, such as watch parts, and blister packed articles of whatever size cannot easily be grouped for shipping or storage.

Swing suspension or 'hammock' packages for shipping delicate articles, in which an inner sling made from an elongated flexible strip of plastic, or cloth, or combinations of plastics, cloth or paper, or from one or more plastic films, including heat-shrinkable films, is used to suspend the article between opposite sides of an outer container, have been known for many years. U.S. Pat. No. 2,501,570, issued Mar. 21, 1950 to Larsen; U.S. Pat. No. 2,837,208, issued June 3, 1958 to Lingenfelter and assigned to Polyfab Company; U.S. Pat. No. 3,660,337, issued June 13, 1972 to Struble and assigned to Diamond International Corporation; U.S. Pat. No. 3,752,301, issued Aug. 14, 1973 to Bluemel, and U.S. Pat. No. 4,030,603, issued June 21, 1977 to Angell and assigned to Angell and Associates, all disclose such packages.

U.S. Pat. No. 3,055,495, issued Sept. 25, 1962 to Naimer, discloses packages having shock-deformable outer members.

Packing products comprising cellular plastic cushioning capsules ". . . having trapped air within the cells providing basic resilience but having small perforations to allow at least a portion of the trapped air to escape under impact conditions to effect a damped cushioning of the protected objects", which capsules are intended to be packed around fragile articles being shipped, are disclosed in U.S. Pat. No. 3,949,879, issued Apr. 13, 1976 to Peterson et al and assigned to Honeywell Inc., at, for example, column 1, lines 38–44 and column 2, lines 44–53 of the patent.

U.S. Pat. No . 2,681,142, issued June 15, 1954 to Cohen, discloses a packing container made up of concave, relatively rigid air-impermeable mating portions or shells, with a resilient diaphragm positioned under tension across one or both mouths of the shells and secured to the periphery of the mouth, such that when two diaphragms are present "the tension of the . . . diaphragms [is] such as to permit the positioning therebetween of an object to be carried in the container" (see, for example, claim 1 of the Cohen patent). Various arrangements of valves and vents to permit the passage of air into and out of either or both shells behind the diaphragms are disclosed, although, according to Cohen, neither shell need have such air passages. The Cohen patent also discloses that when two diaphragms, one across the mouth of each shell, are present, one, but not both, may be airpermeable; see also Baillod Swiss Pat. No. 630,313, issued June 15, 1982 on an application filed June 25, 1979, and Kalle A. G. German Laid-Open Application No. 1,461,963, published May 8, 1969.

SUMMARY OF THE INVENTION

The present invention provides a simple, versatile packaging system to protect delicate, fragile and shock sensitive articles from damage by mechanical shock or vibration, as well as from contamination by environmental factors, particularly moisture and dust, during shipping and storage.

A preferred embodiment of this packaging system, like certain of the packages disclosed in the above-mentioned Baillod Swiss patent, the Kalle A. G. Offenlegungsschrift and the Cohen U.S. patent, comprises two gas-impermeable or essentially gas-impermeable mating portions or shells, either concave or having the ability to become concave in use, each of said shells having an elastic diaphragm or membrane held in elastic tension across its free edge or mouth and secured to all or substantially all of the perimeter of said mouth, the tension being such as to permit the positioning in suspension between the membranes of articles to be contained in the package.

However, in contrast to any of the packages disclosed in the known prior art, in packages produced according to this preferred embodiment of the present invention each of said elastic diaphragms or membranes joined to said mating portions or shells is adapted to permit the passage of air or other gases in restricted fashion therethrough.

Permitting air or other gases to pass from the interiors of each of the shells through membranes which have been adapted to permit the passage therethrough of such gases in restricted fashion, and from the space between the membranes into the shells, in an assembled package incorporating this preferred embodiment of the present invention, while containing the gas within the package by means of a gas-impermeable outer shell, allows the package to function as a fluid damped device. In other words, fluid damping action created by restricting the flow of air or other gas through the membranes from one shell to the other allows the pair of membranes to act as a damped compound spring, and rapidly attenuates mechanical shock and vibration while holding the articles being shipped or stored suspended out of contact with the outer shell.

The fluid damping action accomplished in packages embodying the present invention constructed as just described: with gas-impermeable outer shells and membranes adapted to permit the passage of air or other gases therethrough in restricted fashion, can be approximated or even equalled in packages having a pair of gas-impermeable or essentially gas-impermeable membranes and also having shells adapted to permit air or other gases to pass in restricted fashion out of and into the space between the membrane and the shell in each of the two portions of the package. Such packages can, for example, be provided with one or more vents or holes in each shell, with such vents or holes being sized to provide restricted gas flow and permit the pair of gas-impermeable membranes to act as a damped compound spring. Thus, such packages are also contemplated as being within the scope of the present invention. Unless further modified as described hereinbelow they are, however, considered less suitable for some, although not all, uses than the gas-impermeable shell packages of the present invention, for one or both of the following reasons:

The vents or holes in the shells of such packages must be relatively small to permit only restricted passage of air or other gases out of and into the shells, since vents or holes large enough to prevent the creation of any compression within the space between the membrane and the shell in each of the two portions of the package, such as those disclosed in the Cohen patent at, for example, column 5, lines 33–64, will not permit the package to provide the necessary fluid damping action. Holes sized small enough to permit only restricted gas passage can become blocked by dust or dirt, or by contact with other packages or packaging materials. If this occurs, protection of the article or articles contained within the package from damage due to mechanical shock or vibration will be diminished or lost entirely.

Such packages may not provide adequate protection in certain situations from atmospheric moisture or other gaseous contaminants, since even essentially air-impermeable membranes, unless specially treated, ordinarily do not act as water vapor barriers.

However, in yet another embodiment of the present invention, the relatively small vents or holes in the aforementioned gas-impermeable membrane containing packages can be protected against the entry of dust, dirt or other substances which could block the vents or holes by using, over or in the vents or holes, a filter means. Preferably, this filter means will comprise a material having a low pressure drop at a high flow rate, so as not to interfere with the damping action effected by the passage of air or other gas through the vents or holes. Cellulose acetate filter materials and the like can be employed for this purpose.

Yet another embodiment of the present invention comprises a package having vents or holes in each shell sized to provide restricted gas flow out of and into the shells, preferably although not necessarily filtered in the manner described above, and also having a gas-permeable membrane, preferably a porous or microporous membrane, held in elastic tension across the mouth of each shell and secured to all or substantially all of the perimeter of said mouth. In such packages, the restricted size holes in the shells and the gas-permeable membranes each cooperate to permit restricted passage of air or other gases out of and into the package, thereby providing the necessary damping effect and, once again, permitting the pair of membranes to act as a damped compound spring.

Such packages may be used to ship and store sterilized articles. Sterilization can be accomplished by any suitable means, but preferably by subjecting the article in a fully assembled package, or in a subassembly between two retained membranes, as will be described in greater detail hereinbelow, to a sterilant gas atmosphere. If desired, the sterilant gas in an assembled package or subassembly can be removed, once sterilization has been accomplished, by applying a vacuum to the gas-containing package or subassembly. Once the vacuum is taken off, air or any other gas, nitrogen, for example, will be introduced into a package or subassembly through the pores in the gas-permeable membranes of a subassembly or through the vents or holes in the shells of a fully assembled package, and if an inert gas is used, the package or packages, or a subassembly once it has been made up into a package embodying the present invention, may be shipped or stored in another package which will contain the inert atmosphere, and will be safe to open whenever the article is needed.

In another embodiment of the present invention, restricted gas flow between the two portions of the package is provided by means of gas passages, channels, ducts, ports or the like which bypass the membranes to communicate between the space in one shell contained between the membrane and the shell, and the corresponding space in the other shell. Such gas passages can be provided in any suitable manner, e.g., by molding them into the shells, by drilling or otherwise cutting them into the shells, by leaving a suitably-sized gap or gaps when securing the membranes to the perimeters of the shells, etc. They can be designed to provide the requisite restricted gas flow either by themselves or in cooperation with either or both of (1) a pair of membranes adapted to permit restricted gas passage, and particularly porous or microporous membranes which might not, by themselves, possess sufficient porosity to provide the necessary gas flow, or (2) a pair of shells each having vents or holes sized to allow restricted but insufficient gas flow. In any case, the net effect will be, once again, to permit the pair of membranes to act as a damped compound spring.

The results obtainable by means of the present invention are unachievable in packages having a pair of gas-impermeable membranes acting under pressures ranging from about one-half atmospheric to superatmospheric within a gas-impermeable outer container. In such packages, the membranes act solely as a positioning device, and gas trapped between the membranes and the shells essentially prevents any elastic action by the membranes. As the pressure is increased in such packages, articles contained in them are held more and more rigidly, and a severely overdamped system is created. This permits shock to be transmitted nearly directly to the articles, with only minimal cushioning resulting from the compressability of the contained gas.

Similarly, packages having a pair of gas-impermeable membranes, a pair of gas-permeable membranes or one gaspermeable and one gas-impermeable membrane, and also having vents or holes in their shells so large as to permit air or other gas to pass in unrestricted fashion out of and into the package (thereby preventing the creation of any compression within the package), will create an undamped or a severely underdamped system, and will permit excessive and unattenuated displacement or vibration of articles contained therein when the package is subjected to external shock.

The use of an elastic, gas-permeable membrane, a restricted gas passage, an unobstructed vent or hole sized to permit restricted gas passage, or any combination thereof, in the shell into which the article or articles to be shipped or stored will be loaded also permits air or other gas contained under the membrane to be vented while loading the articles. This minimizes the creation of superatmospheric pressures between the membrane and the outer shell, so that the dynamics of the elastic tension of the membrane applied to the article(s) to be protected can more effectively attenuate shock effects.

The two unassembled sections of packages prepared according to the present invention are not bulky, and can be shipped and stored prior to use in a nested configuration. In addition, filling and assembly of such packages is readily automated, and can be integrated into clean room manufacturing environments without fear of contamination of the atmosphere.

DESCRIPTION OF THE ILLUSTRATED EMBODIMENTS

Figure 1:
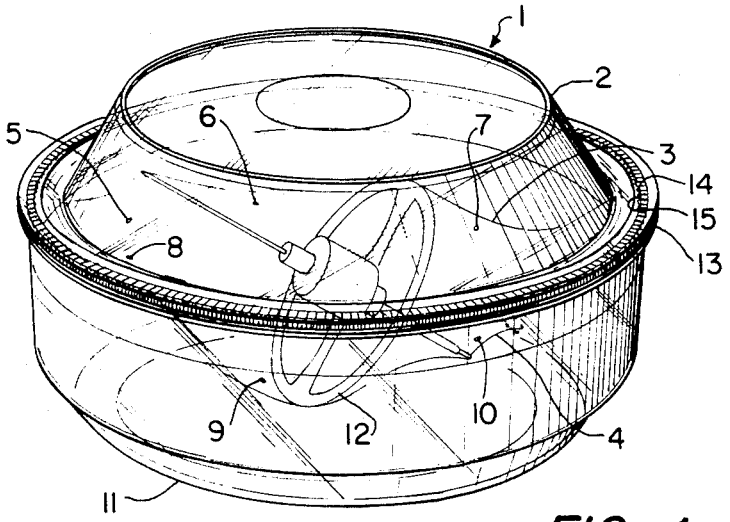
FIG. 1 is a perspective view of a package corresponding to a preferred embodiment of the present invention, containing a watch or clock part.

In FIG. 1, a package 1 made up of a concave, circular, gas-impermeable upper shell 2, injection molded from clear thermoplastic resin, a pair of clear elastic membranes 3 and 4, each adapted to permit the passage of air or other gases therethrough in restricted fashion by means of three holes 5, 6 and 7 randomly punched in the upper membrane 3 and three holes 8, 9 and 10 randomly punched in the lower membrane 4, the membranes 3 and 4 each being held in place, respectively, within the upper shell 2 and a concave, circular, gas-impermeable mating lower shell 11, also injection molded from the same clear thermoplastic resin as the upper shell 2, by an injection molded thin walled mating retaining ring (not shown) molded from the same clear thermoplastic resin as the upper and lower shells 2 and 11, contains a watch or clock part 12. The upper and lower shells 2 and 11 contain on their mating edges 13 rings of serrations 14 and 15, which serve to prevent the shells 2 and 11 from turning with respect to one another once the package 1 containing the part 12 has been assembled.

In a preferred embodiment of the package 1 illustrated in FIG. 1, the upper and lower shells 2 and 11 each have an inside diameter of 80 mm, the membranes 3 and 4 are each made of extruded, 0.04 mm thick polyurethane film, prestretched 5%, and are in planar contact when the package 1 is closed empty (without the part 12), the holes 5, 6, 7, 8, 9 and 10 in the membranes 3 and 4 are each 0.1 mm in diameter, the vertical clearance between the membranes 3 and 4 and their respective shells 2 and 11 is 20 mm, and the gas volume contained between each of the membranes 3 and 4 and its respective shell 2 and 11 before the part 12 is introduced is approximately 86 cc.

Figure 2:
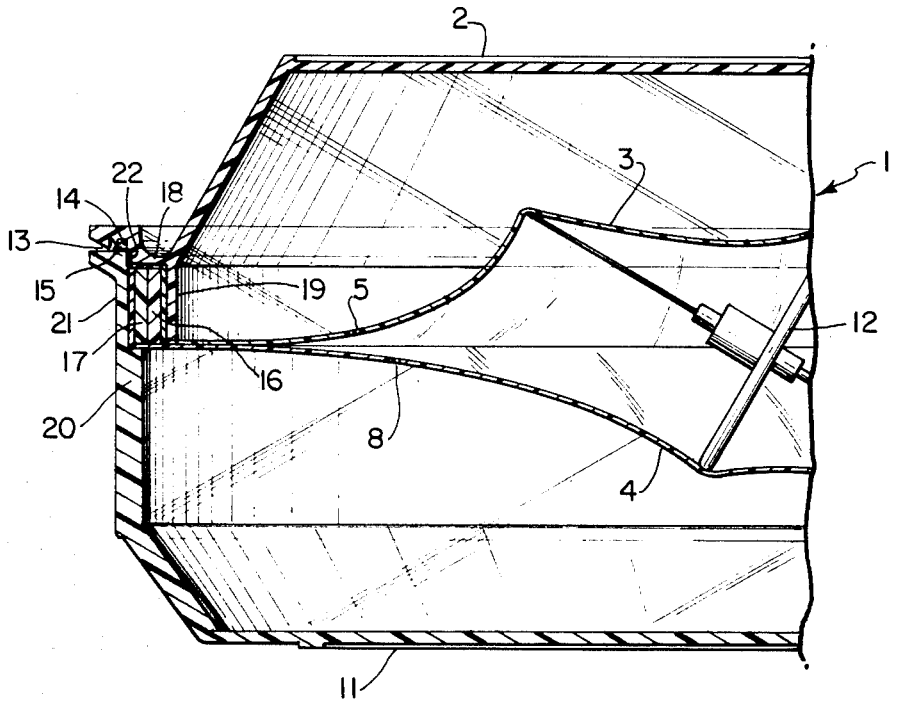
FIG. 2 is a partial cross-sectional view through the center of the package of FIG. 1.

In FIG. 2, an upper thin walled mating retainer ring 16, which holds the upper membrane 3 in place at the mouth of the upper shell 2, and a lower thin walled mating retainer ring 17, which holds the lower membrane 4 in place within the lower shell 11, are shown in profile. Also shown in profile are the serrations 14 and 15 at the mating edges 13 of the upper and lower shells 2 and 11, a shoulder or ledge 18 and a side wall portion 19 in the upper shell 2 against which the upper retainer ring 16 is seated, a shoulder or ledge 20 and a side wall portion 21 in the lower shell 11 against which the lower retainer ring 17 is seated, and, illustrating another preferred embodiment of the present invention which will be employed whenever a hermetically sealed package is desired, an extension or ruff 22 of the upper membrane 3 which, when the upper shell 2 is mated with the lower shell 11, forms a sealing means or gasket around the edges 13 of the package 1 to give an airtight closure.

Figure 3:
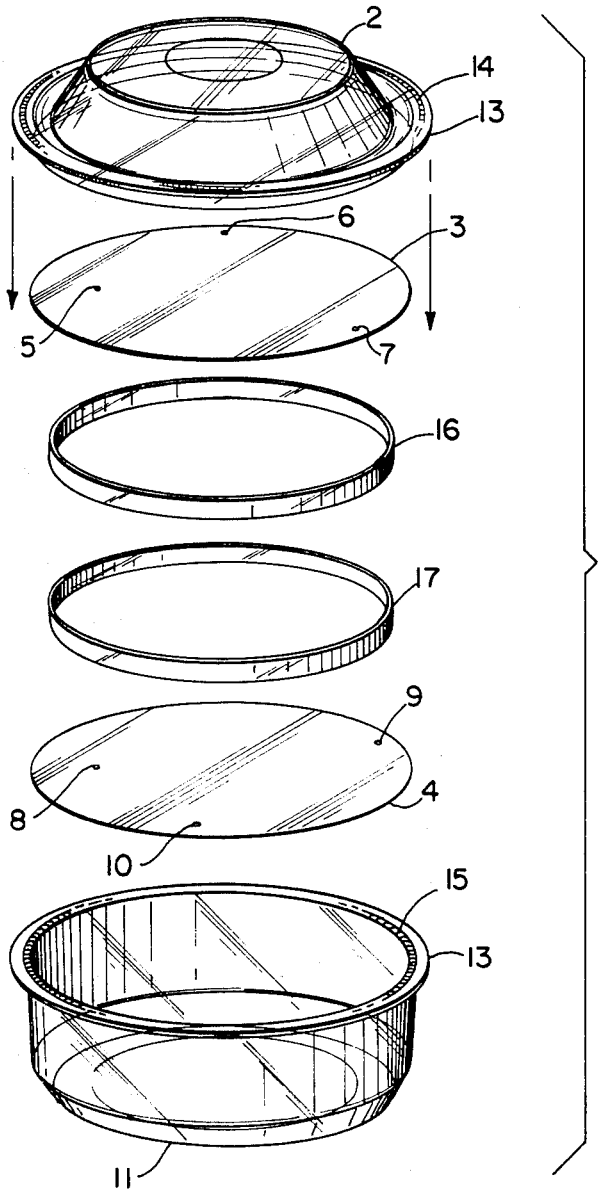
FIG. 3 is an exploded view of the package of FIG. 1.

The upper and lower retaining rings 16 and 17 can be seen in their entirety in FIG. 3.

Figure 4:
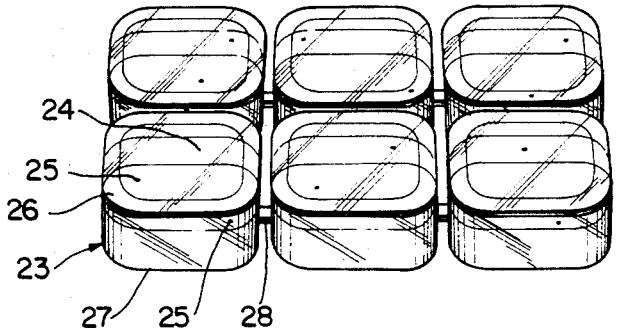
FIG. 4 is a perspective view showing a separable cluster of packages embodying the present invention.

In FIG. 4, a plurality of square shaped, rounded corner packages 23, having an upper shell 26 and a lower shell 27 each molded from clear thermoplastic resin, are shown. Each package 23 contains a pair of clear elastic membranes 24, each of which contains a randomly punched hole 25. The membranes 24 are each held in place in the upper shell 26 and the lower shell 27, respectively, by means of upper and lower injection molded thin walled mating retainers (not shown) molded from the same clear thermoplastic resin as the upper and lower shells 26 and 27. The packages 23 are held together by breakable, molded-in bars 28 which permit them to be detached from each other either before or after being filled.

DETAILED DESCRIPTION OF THE INVENTION

The shells employed in the novel packaging systems of the present invention are preferably relatively rigid. They need not necessarily be rigid, however, and in certain embodiments of the invention the materials used for the shells may be flexible and inflatable to form gas-impermeable shells containing membranes adapted to permit the passage of air or other gases therethrough in restricted fashion, gas passages similarly adapted, or both. Ordinarily, however, the shells comprise two relatively rigid cup-shaped or bowl-shaped parts whose free edges or mouths are provided with flanges, recesses, grooves, protrusions, ledges, lips or the like designed to permit both shells to fit together intimately when joined one with the other, forming a top and bottom for the package. Preferably, the open end or mouth of each shell is in the shape of a circle or an elipse, but nearly any other curved shape, or a figure of any number of straight sides is acceptable as long as acute inside angles between sides are avoided and generous radii are used to join the straight or curved sections. The cup-shaped or bowl-shaped parts or shells may have straight or curved vertical sides. Advantageously, the sides will be tapered to permit unassembled pieces to be nested for shipment and storage.

The lower shell is usually flat for stability, but it may be ridged, grooved or otherwise shaped to mate with the exterior of the opposing part to impart improved stability when one assembled package is stacked on another. The shells may be manufactured from any suitable material, including metals, ceramics, wood, glass or the like, but are especially suited to precision injection molding from thermoplastic materials. By using a clear, relatively rigid plastic such as polystyrene, high density polyethylene, polypropylene, polycarbonate or the like for the shells, and a clear plastic film for the membranes, the packaged parts may be easily seen without opening the package. And even if the membranes are opaque in such a package, the outline of the packaged articles therein will be visible through the shells.

The material used to make the shells ordinarily should be tough and resistant to cracking or breakage so as to maintain the integrity of the protective package.

A flange, recess, groove, protrusion, ledge, lip or the like will be provided in the open end of each shell to position and retain the edges of the elastic membrane. When the two shells are mated, one with the other, the two membranes preferably will be substantially parallel, one with the other, and more prefereably will be in planar contact when the package is empty. While the membranes may be separated by any reasonable distance to accomodate oddly shaped parts, and may be out of parallel to any degree that will nonetheless prevent the article or articles being shipped or stored from moving to the rim of the shell, for normally shaped parts maximal shock protection will be obtained when the edges of the membranes are in planar contact. A membrane may be attached to a shell by any suitable means, including but not limited to chemical or adhesive bonds, heat seals, snap retainers, heat shrink sleeves or compression flanges, depending on the compatibility of the materials involved.

A preferred embodiment of the present invention utilizes a mechanical friction retaining ring, made of plastic, metal or any other suitable material, to pre-stretch the membrane and hold it in the proper position across the mouth of the shell.

In another preferred embodiment, the lower shell of the package can have an internal recess machined, molded or otherwise formed near its top edge or mouth such that the sides of the recess are perpendicular to the bottom surface of the shell and its bottom edge or rim is parallel to the bottom of the shell. A thin-walled mating piece or retainer, which will just slide into and fill the recess in the shell, will be provided. When a suitable piece of elastic film is positioned over the mouth of the lower shell and the thin-walled mating retainer is pressed into the recess in the shell to compress the film between inner wall of the recess and the outer wall of the thin-walled mating retainer, the film will be stretched by mechanical friction acting on its edges and, when the thin-walled mating retainer reaches the bottom of the recess, the film is disposed at the proper position and the proper pre-stretch for mating with the upper shell of the package.

Similarly in this preferred embodiment, the upper shell will be provided with an outer thin-walled mating retainer. When the elastic membrane is assembled by pressing the thin-walled mating retainer over the shell, capturing the membrane between the outside of the shell and the inside of the thin-walled mating retainer, a mating pre-stretched membrane is formed. When the inside of the lower thin-walled mating retainer and the outside of the upper thin-walled mating retainer are shaped so that the latter fits intimately inside the former, and if positioning flanges, recesses, grooves, protrusions, ledges, lips or the like are provided on the mating shells, the two membranes will be disposed in parallel and, if desired, in planar contact with each other when the two assemblies are joined.

In another embodiment of the present invention a membrane is first secured to each of a pair of retainers, preferably retainers having means which permit them to be fastened together once joined. A shell can then be joined to each retainer, either before or after the retainers are fastened together. In cases where the retainers themselves do not contain means to permit them to be fastened together once joined, they can be fastened, if desired, by externally-supplied means before being joined to the shells, or the shells themselves can contain fastening means which will secure the entire assembly. Alternatively, the entire package can be secured, once joined, by externally-supplied means.

Assemblies of this type, made by first securing the membranes to the retainers, next placing an article between the membranes and then joining the entire assembly by first fastening the retainers and then adding the shells, or by joining the retainers and fastening the assembly by means of the shells or by means supplied after the shells are joined, readily lend themselves to automated packaging processes. Included among such processes are those in which twist or snap-fit retainers, each bearing a porous or microporous film, are fastened together around an article, this subassembly is sterilized using, for example, ethylene oxide gas, the resulting sterilized subassembly is closed between two shells each having vents or holes sized to permit restricted gas passage, a vacuum is applied to the thus-assembled package to remove the sterilant gas, the vacuum is taken off, and air or another gas is then permitted to fill the package.

Subassemblies of membrane-bearing retainers enclosing articles for assembly into packages embodying the present invention can also be made by placing the article to be shipped or stored between two sheets of membrane-forming film, juxtaposing a retainer on each side of the film sandwich, and then trimming the films around the outer edges of the retainers, leaving a subassembly of retainers bearing membranes enclosing the article.

A subassembly of membrane-bearing retainers enclosing articles for assembly into packages embodying the present invention, including subassemblies which will be sterilized once an article has been placed in them, can of course have as the membranes porous or microporous films and can be assembled with gas-impermeable shells, so long as the porosity of the membranes is sufficient to provide the necessary damping effect or the shells have been provided with restricted gas passages to provide or help provide this effect.

The passage of air or another gas or gases in restricted fashion through the membranes can be accomplished by using a porous (including microporous) film as the membrane material, or by making one or more holes in each membrane. If the latter expedient is employed, it is preferred that the holes will be positioned towards the peripheries of the membranes, i.e., towards their edges which are in contact with the mouths of the shells. This will help to insure that the holes will not be blocked by the article or articles packaged.

Any number of elastic film materials can be employed as the elastic membranes. Preferably, the membranes employed will be made from a film which exhibits high tensile strength, toughness, high tear resistance, a low modulus of elasticity, low stress relaxation under tension, and a high degree of extensibility without permanent deformation. Although porous and impermeable materials may both be used, porous films are usually more expensive, and normal control of gas passage through the membrane to effect fluid damping is easily accomplished by making a hole or holes in impermeable materials.

Included among such films are low density polyethylene, polybutylene, microporous polypropylene and rubber. A preferred material having an excellent combination of properties for this purpose is clear polyurethane film.

The thickness of the membrane will depend on physical properties of the film employed, the weight of the article to be suspended, and the physical dimensions of the package. In general, the mimimum thickness will be that required to limit the deflection of the pre-stretched membrane due to the weight of the article to be packaged being disposed upon it to less than about 5% of the shortest straight line distance between opposing edges of the membrane passing through the geographical center of the membrane, but in certain cases the deflection may go as high as 30% of this distance without reducing effective protection, if an appropriate degree of damping is utilized. The thinnest possible membrane should be used in order to impose minimum static force on the packaged article and provide the softest spring action feasible for protection against mechanical shock and vibration. For optimum protection of the packaged article the membranes above and below the article preferably should be of the same material and thickness, have the same surface shape and area, be pre-stretched to the same degree, have the same venting area (punched holes or porous passages) through the membrane, and have the same volume of gas space between the undeflected membrane and its assembled shell. Polyurethane films of about 0.025–0.04 mm. in thickness have proven to be especially useful in boxes used to ship and store watch parts, movements and cases.

Preferably, the membrane will be installed across the open end or mouth of the shell with a pre-stretch of 0 to about 50%, and more preferably with a pre-stretch of from about 2% to about 5%, of any unsupported straight line dimension passing through the geographic center of the installed membrane.

By proper choice of the material and dimensions of the membranes, and by adapting the membranes, the shells or both to permit the restricted passage of air or other gas at a given rate within the package or out of and into the package such that the damping achieved will not exceed critical damping for the system (or in other words, the degree of damping achieved can range from subcritical to critical, but in all cases will be less than overdamping), a package embodying the present invention can be designed for an article or articles of a given weight such that when said package is subjected to a given external force or forces, the maximum displacement of the article or articles contained by the membranes within the package will be less than that which will permit the article or articles to strike the insides of the package.

The requisite membrane thickness, elasticity and pre-stretch, edge geometry, package volume, membrane hole size and number or porosity, shell hole size and number, etc. that will provide adequate protection from mechanical shock and vibration can easily be determined by experimentation, and exact values can be calculated by one skilled in the art by treating the membranes as a compound spring coupled with the fluid damping of the entrapped gas passing in restricted fashion through the holes or pores in the membranes, the vents, holes or passages in the shells, or any combination thereof. Equations by which one can calculate the necessary factors mentioned above may be found in, for example, the article entitled "Vibration", by William T. Thompson, which appears at pages 5-67 through 5-71 of "Marks' Standard Handbook for Mechanical Engineers", 8th Ed. (New York: McGraw-Hill Book Company, 1978); see particularly the differential equations of motion for free and forced vibrations.

As indicated hereinabove, while air may be the gas employed in the packages of the present invention, nitrogen, argon or any other inert gas or mixture of gases, sterilant gases such as ethylene oxide, and the like, can also be used. Whatever gas is used, its density, viscosity and other fluid properties must be taken into account when establishing the rate of restricted flow through the membranes or out of and into the package so as to insure the necessary degree of damping.

Articles will normally be packaged in packages embodying the present invention with their longest and median dimensions in the plane of the elastic membranes and their shortest dimension perpendicular to that plane. When designing the shape of the package the distance between any two opposite points on the fixed perimeter of the membrane preferably will be between about 1.25 and about 3 times the intersected straight line dimension of a part disposed on the membrane, and more preferably between about 1.5 and about 2 times that dimension, but may be any higher convenient multiple as long as the other variables are duly considered in the design of the package. The vertical clearance between the undeflected membrane and the bottom of the bowl-like shell in either section of the package should be equal to or greater than the maximum perpendicular dimension of a part disposed on the undeflected membrane to avoid damage to the article if the package is subjected to shock. The package dimensions preferably will be chosen so that if a membrane were to be deflected to contact the interior surface of the shell, the elastic limit of the membrane would not be exceeded, and no permanent deformation would occur.

The assembled packages may be sealed by any suitable means, either built into the package itself or externally-supplied, including adhesive seals or tape, glue, intermeshing notches or serrations, twist-or snap-fit members, bolts or screws, clamps or the like. The membranes may be held in contact entirely around their edges to provide a hermetic seal if desired, or a ruff 22 as illustrated in FIG. 2 may be provided to accomplish the same result. However, simple mating contact of the edges of the shells, with the two parts of the package being held together by tensional or frictional contact, will usually suffice.

If the edges of the package at which the two shells join are circular in shape, they may be provided with complimentarily-fitting notches, serrations or undulations to prevent the assembled shells from turning with respect to each other, as shown in FIG. 1.

An article packed in a single package according to the present invention may sometimes move within the membranes towards one edge thereof under the influence of sufficient force applied to the membrane-bearing edge of the package, depending on such factors as the size and shape of the article, how much tension has been applied to the membranes, the film from which they have been formed, how close together they are, the configuration of the article itself, etc. If, however, a nest of three such packages, one inside another, is assembled with the innermost package containing the article and with the membranes of the three packages aligned so as to define orthogonal axes, protection will be provided against a force applied from any direction moving the article towards the edges of the membranes in its package. Such a package configuration would be especially suitable for transporting shock-sensitive explosive substances such as nitroglycerine.

It will be obvious to those skilled in the art that other changes can be made in carrying out the present invention without departing from the spirit and scope thereof as defined in the appended claims.

I claim:

1. A package comprising a pair of concave mating portions and an elastic membrane secured in elastic tension to the periphery of the mouth of each of said mating portions, said tension being such as to permit the positioning between said membranes of articles to be contained in said package, said package being a fluid dampening device in which dampening results from restricted gas flow with said membranes acting as a damped compound spring protecting articles positioned therebetween from mechanical shock and vibration.

2. A package as described in claim 1 wherein said concave mating portions comprise relatively rigid shells.

3. A package as described in claim 2 wherein said shells are injection molded from thermoplastic resin.

4. A package as described in claim 1 wherein said concave mating portions comprise relatively rigid shells injection molded from clear thermoplastic resin and said membranes comprise polyurethane film.

5. A package as described in claim 1 with said concave mating portions being gas-impermeable and said membranes permitting the passage of gas in restricted fasion therethrough.

6. A package as described in claim 5 wherein said membranes each have at least one hole punched therein.

7. A package as described in claim 5 wherein siad membranes comprise porous or microporous film.

8. A package as described in claim 6 wherein said concave mating portions comprise relatively rigid shells injection molded from clear thermoplastic resin and said membranes comprise polyurethane film.

9. A package as described in claim 1 with said concave mating portions permitting the passage of gas in restricted fashion out of and into the space between said membrane and said concave mating portion and said membranes being gas-impermeable.

10. A package as described in claim 9 wherein said concave mating portions each have at least one vent therein permitting restricted gas flow therethrough.

11. A package as described in claim 10 wherein said concave mating portions comprise relatively rigid shells injection molded from clear thermoplastic resin and said membranes comprise polyurethane film.

12. A package as described in claim 1 permitting its contents to be sterilized wherein said concave mating portions each have at least one vent therein permitting restricted gas flow therethrough and said membranes comprise porous a microporous film.

13. A package as described in claim 12 wherein said concave mating portions comprise relatively rigid shells.

14. A package as described in claim 13 wherein said shells are injection molded from clear thermoplastic resin.

15. A package as described in claim 14 with said shells permitting the passage of gas in restricted fashion within said package by means of gas passages which bypass said membranes to communicate between the space in one of said shells between said shell and its membrane and the corresponding space in the other of said shells.

16. A package as described in claim 1 with said concave mating portions permitting the passage of gas in restricted fashion within said package by means of gas passages which bypass said membranes to communicate between the space in one of said concave mating portions between said concave mating portion and its membrane and the corresponding space in the other of said concave mating portions.

17. A package as described in claim 16 wherein said membranes comprise porous or microporous film.

18. A package a described in claim 17 wherein said concave mating portions comprise relatively rigid shells injection molded from clear thermoplastic resin.

19. A package as described in claim 1 containing an article.

20. A nest of three packages as described in claim 1, one inside another, with the innermost of said packages containing an article and with the membranes of each of said packages being aligned so as to define orthogonal axes.

* * * * *